United States Patent [19]

MacMillan

[11] 4,383,469

[45] May 17, 1983

[54] APPARATUS AND METHOD FOR COVERING PRIMER FLASH HOLES

[75] Inventor: John T. MacMillan, No. Little Rock, Ark.

[73] Assignee: Remington Arms Company, Inc., Bridgeport, Conn.

[21] Appl. No.: 286,283

[22] Filed: Jul. 23, 1981

[51] Int. Cl.[3] ..... F42B 5/02; F42B 9/02

[52] U.S. Cl. ..... 86/10; 102/204; 102/470

[58] Field of Search ..... 86/10; 102/204, 283, 102/292, 470

[56] References Cited

U.S. PATENT DOCUMENTS 3,535,978 10/1970 Stadler ..... 86/10
3,581,619 6/1971 Makay ..... 86/10
4,353,304 10/1982 Hübsch et al. ..... 102/470

FOREIGN PATENT DOCUMENTS 752333 8/1970 Belgium ..... 102/470

*Primary Examiner*—Leland A. Sebastian
*Attorney, Agent, or Firm*—Nicholas Skovran; William L. Ericson; Barry Estrin

[57] ABSTRACT

Apparatus and method for covering the flash holes in a primer battery cup, particularly where the anvil is formed integrally with the battery cup. Tooling apparatus is provided which includes a spring-loaded punch positioned and slideable axially within an outer punch. A covering medium such as paper is delivered to the tooling station as a strip where it is pierced and slit by the spring-loaded inner punch and blanked by the outer punch. The blanked portion is inserted into the battery cup and seated over the flash holes at the bottom of the cup around the anvil.

16 Claims, 10 Drawing Figures

APPARATUS AND METHOD FOR COVERING PRIMER FLASH HOLES

BACKGROUND OF THE INVENTION

1. Field of the Invention

The present invention relates to primers for small arms ammunition which have covered flash holes. More specifically, the present invention relates to covering multiple flash holes in a unitary primer assembly where the battery cup and anvil have been formed integrally.

2. Description of the Prior Art

Conventional primers for small arms ammunition usually include three separate metal components: a primer cup, an anvil and a battery cup. The primer cup contains an impact sensitive explosive priming mixture for igniting the propellant powder charge of the ammunition cartridge. The battery cup serves as a support for the anvil and primer cup and contains at least one flash hole. The flame and heat produced by the detonation of priming mixture upon impact to the anvil will travel through the flash hole to ignite the propellant powder.

The flash holes of conventional primers may or may not be covered. The advantages of a covered flash hole have long been recognized. A closed flash hole prevents the explosive priming mixture from dusting out of the primer after it has been charged and also reduces static electricity hazards.

Another advantage is that a closed flash hole prevents propellant powder from entering the priming mixture chamber. This permits the use of fine grain propellant powder without having the fine powder sift into the battery cup through an open flash hole. The presence of fine propellant powder within the battery cup is objectionable because the ignition of powder within the relatively confined area of the battery cup may cause excessive pressure and blow the primer cup rearwardly away from the battery cup.

A closed flash hole construction also permits rapid identification of pre-fired primers. Such primers can be recognized readily by the condition of the flash hole cover.

The potential for flame-induced mass detonation of primers packed in bulk is also reduced significantly by the covered flash hole construction. Mass detonation is an almost instantaneous chain reaction type of explosion which can occur when one primer is ignited and in turn ignites adjacent primers. Covered flash holes prevent the flame of an accidentally ignited primer from entering adjacent primers and thus reduces the risk of mass detonation.

Two methods are employed generally for covering flash holes in conventional primers. The first involves the insertion of a paper disc directly over the flash hole inside the battery cup. The disc covers the bottom surface of the battery cup and is secured in place by the anvil which is inserted subsequently. The second method utilizes a liquid such as a lacquer. The lacquer is wicked over the flash hole from the outside of the battery cup and allowed to dry.

The paper disc method offers several technical and safety advantages over the liquid technique for covering flash holes during the manufacturing process. Safety in production is improved when the paper disc is used since the primer can be final assembled while the priming mixture is wet and thus less sensitive. The moisture can then be driven off through the paper disc at a later time to sensitize the priming mixture when exposure of personnel to accidental discharge is minimized. Moreover, working with paper results in a cleaner and more desirable overall production operation than the use of lacquer type liquid. The latter, for example, requires controlling the minute application and drying of the lacquer liquid.

More recently, technical developments in the field of complex progressive dieing tools have led to primer configurations wherein the anvil and battery cup are formed integrally from a single piece of metal. An example of such an integral anvil-battery cup (hereinafter referred to as "anvilled battery cup" or "ABC") primer is described in U.S. Pat. No. 4,029,015 granted on June 14, 1977 to M. Lachaussee and A. Maigret. The anvilled battery cup construction of this patent is illustrated in FIGS. 5–7 and includes multiple flash or vent holes at the bottom of the battery cup arranged around an axially and inwardly extending pressed part forming the anvil. Because the anvil is integral with the battery cup and also because the anvil is shaped like a fluted cone, covering the multiple flash holes in this type of primer presents unusual problems not present in conventional primers.

There are several possible solutions to covering the flash holes in anvilled battery cup primers. An integral metal flap can be provided at the flash hole such as described in U.S. Pat. Nos. 3,352,240 and 3,363,563, both granted to G. R. Eckstein on Nov. 14, 1967 and Jan. 16, 1968, respectively, and assigned to the same assignee as the present invention. Although the integral metal flap designs of these patents offer numerous advantages, they add an additional degree of complexity to the already complex progressive drawing techniques necessary to form the integral anvil and battery cup metal piece.

The lacquer type liquid technique discussed earlier is presently being used in some instances to cover the flash holes of anvilled battery cup primers similar to that described in the aforenoted U.S. Pat. No. 4,029,015. This technique, however, continues to suffer the same disadvantages encountered with its use in conventional primers described earlier.

The use of paper as the covering medium would appear to be the preferred method of covering flash holes in anvilled battery cup primers, as it is in conventional primers. Since the anvil is formed integral with the battery cup, however, it is not possible simply to insert a paper disc into the bottom of the battery cup as may be done when working in conventional primer assemblies where the anvil is inserted after the paper disc and also serves to secure the disc in place over the flash holes. Moreover, the irregular shape of the fluted conical anvil in the anvilled battery cup construction shown in FIGS. 5–7 makes it unusually difficult to insert a covering medium such as paper along the bottom of the battery cup rapidly and cover the flash holes effectively in a high speed production operation.

SUMMARY OF THE INVENTION

The present invention overcomes the above-described difficulties and disadvantages associated with the covering of flash holes by providing a novel method and apparatus for blanking and inserting a covering medium such as paper or equivalent foil material into an anvilled battery cup.

The method and apparatus of the present invention contemplates inserting a covering medium such as paper into an anvilled battery cup containing one or more flash holes. The paper is pierced, blanked, inserted and seated into the bottom of the battery cup around the integral anvil in a single station tooling step by means of a tool which includes a pointed, spring-loaded punch within a blanking and seating punch. The pointed punch pierces and slits the paper without removing any material. It also maintains the pierced paper in correct alignment during blanking and insertion by the outer blanking punch so that it will be seated securely at the bottom of the battery cup to cover all flash holes.

The nature and novel features which are characteristic of the present invention, as well as other objects and advantages thereof, will become more apparent from consideration of the following description taken in connection with the accompanying drawings, in which:

DESCRIPTION OF THE PREFERRED EMBODIMENTS

Figure 1:
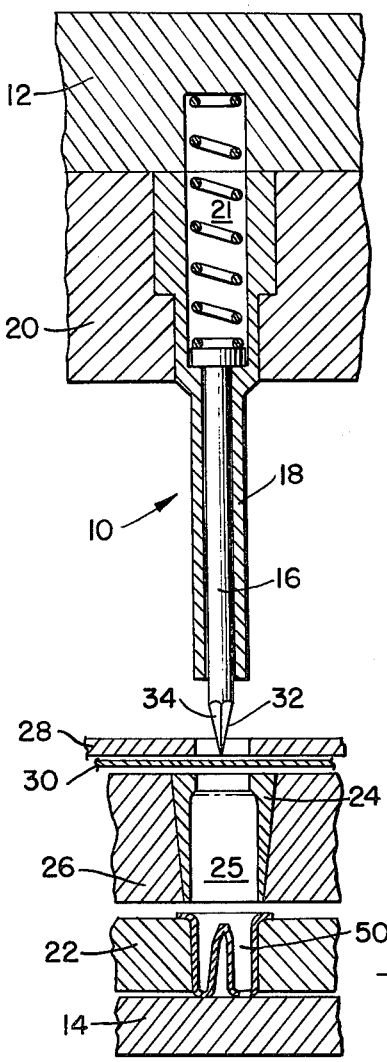
FIG. 1 is a cross-sectional view of the tooling apparatus employed in a first embodiment of the present invention for covering the flash holes in an anvilled battery cup.

The tooling apparatus 10 of a first embodiment of the present invention is illustrated in the cross-sectional view of the work station of FIG. 1. The tooling is set in a die comprising an upper die shoe 12 and a lower die shoe 14. The entire die may include multiple stations for indexing and delivering primer battery cups to the work station.

The tooling apparatus 10 comprises a pointed, spring-loaded lancing punch 16 positioned within an outer blanking punch 18 so as to be slidable axially with respect to the outer punch. The blanking punch 18 is set within a punch holder 20 attached to the upper die shoe 12. A spring 21 is positioned axially within the upper portion of the blanking punch 18 between the upper die shoe 12 and the other end of the lancing punch 16 so as to spring bias the latter downward.

A carrier 22 is located adjacent the lower die shoe 14 and transports anvilled battery cups to the work station. Each battery cup 50 is positioned within an opening in the carrier 22 and is oriented so that its open end faces punches 16 and 18.

Positioned above the carrier 22 is a die 24 located within a die holder 26. The die 24 has a cylindrical axial cavity 25 aligned with punches 16 and 18 and with the opening in the carrier containing the battery cup. The diameter of the upper portion of the die cavity 25 is smaller than the lower portion and is equal approximately to the outer diameter of punch 18, yet providing sufficient clearance for the punch to enter the cavity.

A stripper 28 is located between the die 24 and the punches 16 and 18. The stripper has an opening which is aligned with and has a diameter equal approximately to the upper end of the axial cavity 25 of the die 24. A strip 30 of paper or equivalent foil is transported between the stripper 28 and die 24, blocking the space between the aligned openings of each.

The point 32 of the lancing punch 16 is shown in FIG. 1 in its initial upper position at the top of the stroke of the upper die shoe 12, and is located at the center of the opening of the stripper 28 above the paper strip 30. The point 32 has a number of flats 34 spaced circumferentially. For example, the point 32 may have four flats spaced at 90 degrees. The purpose of these flats is to enable the lancing punch 16 to pierce and cause the paper strip 30 to be slit in a predictable manner. If the point 32 were round in cross-section, it would tear the pierced holes unpredictably. This in turn could adversely affect alignment of the paper during insertion around the integral anvil of the battery cup 50, and result in partially covered flash holes.

In order to better understand and appreciate the operation of the tooling as shown in FIGS. 1–4, the anvilled battery cup 50 of FIGS. 5–7 will be described briefly. The battery cup 50 is essentially the same as that of the earlier-mentioned U.S. Pat. No. 4,029,015. It comprises a tubular cylindrical chamber open at the top and having three flash holes 52 located peripherally at the otherwise closed bottom end 54. The anvil 56 is shaped like a fluted cone and extends inwardly from and is integral with the bottom of the cup. The anvil 56 has a lower portion 58 which is generally conical and an upper portion 60 which is tapered and also generally conical. The top 62 of the anvil is flat.

Figure 6:
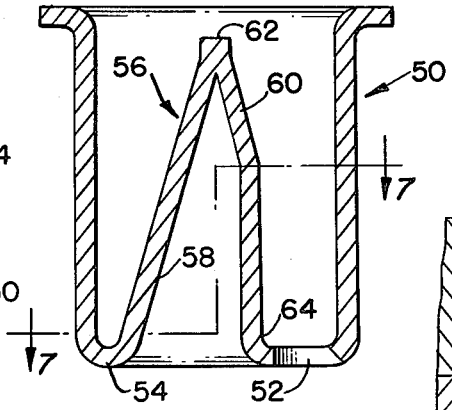
FIG. 6 is an axial cross-sectional view of the anvilled battery cup of FIG. 5 taken along line 6—6 of FIG. 7.
Figure 7:
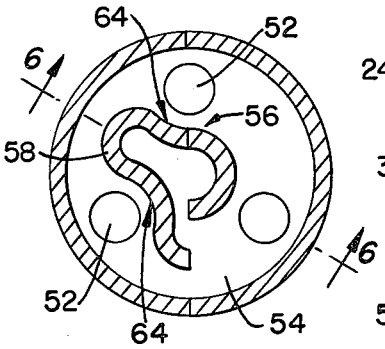
FIG. 7 is a cross-sectional view taken along line 7—7 of FIG. 6.

The lower portion 58 of the anvil has grooves or radial stiffening ribs 64 extending along three diametrical planes at 120 degrees from each other, as shown partially in FIGS. 6 and 7. Along the lower portion 58, the ribs are parallel to the longitudinal axis of the anvil 56. The rib depth is at its maximum at the bottom of the battery cup and decreases to zero at the upper tapered portion 60. The flash holes 52 are located at the bottom 54 where the rib depth is at its maximum.

Since the above-described anvil is both integral and has a fluted conical shape, insertion of paper into the battery cup to cover the flash holes properly presents unusual challenges. The outside diameter of the paper must extend to the wall of the cup and its inner diameter must be large enough to clear the legs of the lower portion 58 of the anvil between the ribs 64, yet be small enough to cover the inner portion of each of the flash holes 52 located where the ribs' depth is at its maximum. The tooling apparatus 10 of FIG. 1 is able to accomplish these requirements efficiently in a manner well suited for rapid mass assembly production, as described below with reference to FIGS. 2–4.

Figure 2:
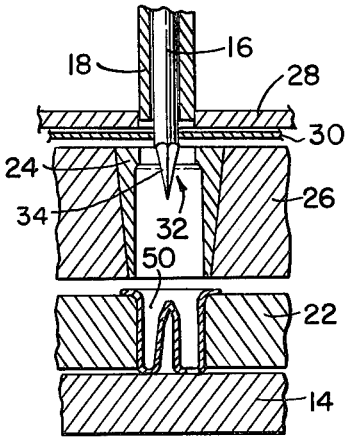
FIGS. 2–4 are partial cross-sectional views illustrating the progressive stages of the tooling apparatus of FIG. 1 in piercing, blanking, and seating paper over the flash holes.

The upper die shoe 12 has a downward stroke sufficient to bring the lower end of the blanking punch 18 downward into the bottom of the anvilled battery cup 50. As the upper die shoe 12 begins to move down, the paper strip 30 is pierced by the point of the lancing punch 16 as shown in FIG. 2. As noted earlier, the flats 34 at the point will cause the paper to slit predictably as the point pierces and moves through the paper and into the axial cavity 25 of die 24. No paper is removed during this piercing and slitting operation.

Figure 3:
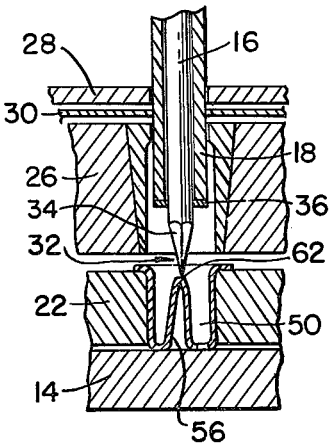

As the upper die shoe 12 moves further downward, the blanking punch 18 will move down through the opening in the stripper 28 and into the axial cavity 25 of the die 24, blanking a disc of paper 36 from the paper strip 30 in the process, as shown in FIG. 3. The downward movement of the lancing punch 16 will stop when it comes into contact with the top 62 of the anvil 56. At this point, the blanked paper disc 36 is located at the foreward end of the blanking punch 18. Its outer diameter is defined by the diameter of punch 18 while its center surrounds punch 16, having been pierced and slit outward from the center by point 32 and flats 34.

Figure 4:
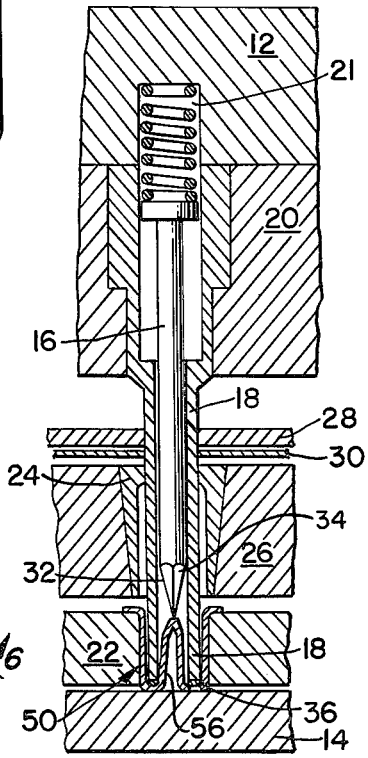
Figure 5:
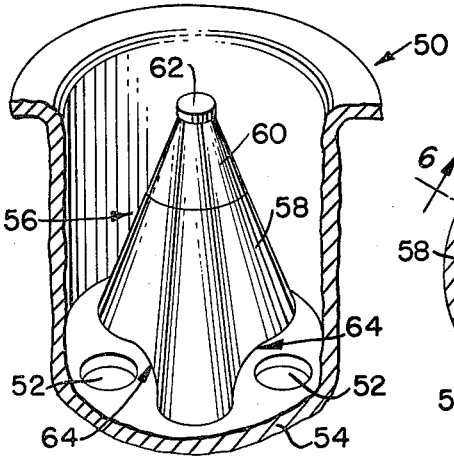
FIG. 5 is a partial perspective view of the anvilled battery cup used with the tooling apparatus of the present invention.

In FIG. 4, further downward movement of lancing punch 16 is prevented when it reaches the top 62 of the anvil 56. The die shoe 12, however, continues downward in its stroke, causing the blanking punch 18 to slide axially downward around punch 16. Increased compression tension from spring 21 will increase the pressure of the point 32 against the anvil's top 62, thus keeping the lancing punch 16 in alignment during the insertion and seating of the paper disc 36.

As the upper die shoe 12 continues to the bottom of its stroke, the blanking punch 18 will slide downward into the battery cup 50 around the anvil 56. The end portion of the blanking punch is contoured so that it can move downward around the fluted conical shape of the anvil. The blanking punch will seat the paper disc firmly at the base of the anvil by compressing the paper between the anvil ribs 64 and the battery cup interior wall, and will thereby completely cover the flash holes 52 located at the bottom of the cup.

The cuts formed earlier at the center of the paper disc 36 by the flats 34 will slit further in a predictable manner as the paper disc is forced downward around the fluted conical shape of the anvil 56, and particularly around the ribbed lower portion 58. At the bottom of the stroke, the paper disc 36 is seated evenly at the bottom of the battery cup and covers all flash holes completely. The die shoe 12 is then raised to the top of its stroke, and another battery cup is indexed into position for insertion of the paper disc to repeat the process.

Figure 8:
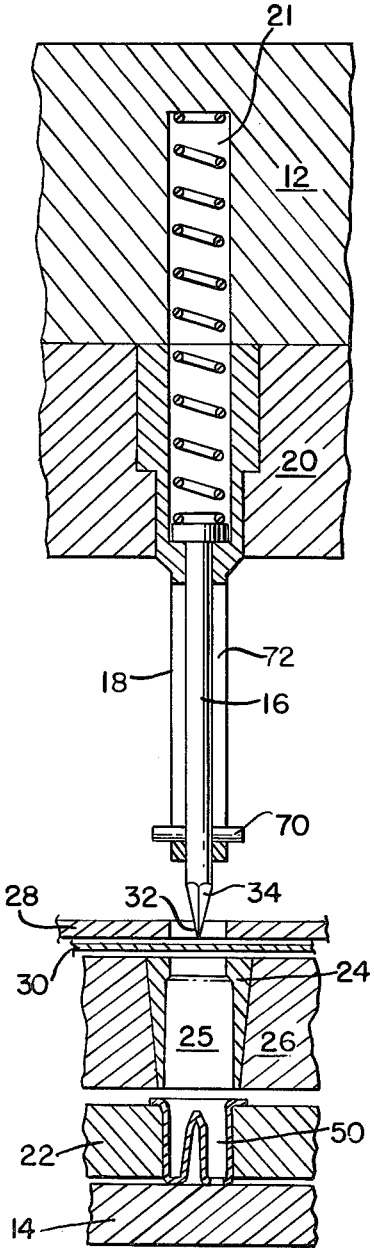
FIG. 8 is a cross-sectional view of the tooling apparatus employed in a second embodiment of the present invention.
Figure 9:
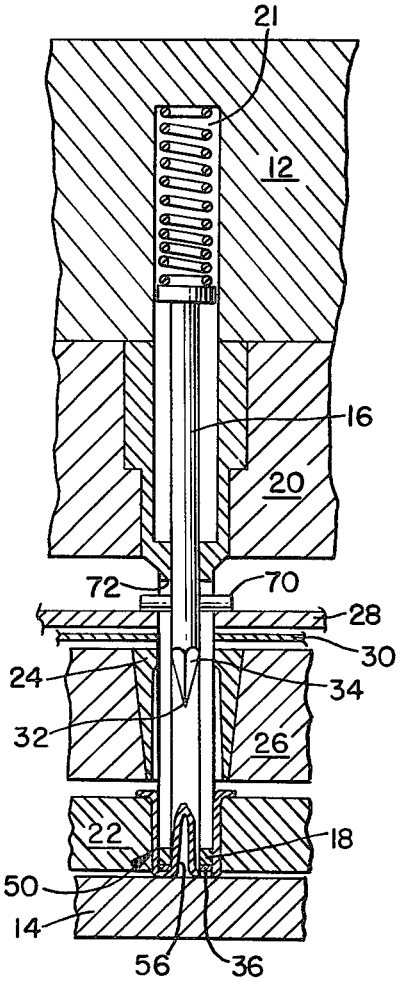
FIG. 9 is a cross-sectional view illustrating the tooling apparatus of FIG. 8 at the stage where the paper has been pierced, blanked and seated over the flash holes.
Figure 10:
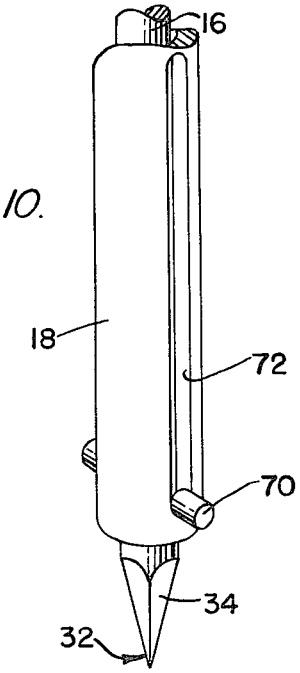
FIG. 10 is a partial perspective view of the tooling punch of FIGS. 8 and 9.

In another embodiment of the present invention shown in FIGS. 8–10, the downward movement of the lancing punch 16 is stopped before its point 32 reaches the anvil 56. This is accomplished by a pin 70 secured to and passing through the lower end of the lancing punch 16. The blanking punch 18 is provided with slots 72 for the pin 70 to move along so that the two punches can still slide axially with respect to one another.

In this embodiment, further downward movement of the lancing punch 16 is prevented when the pin 70 reaches and is stopped by the stripper 28, as shown in FIG. 9. The die shoe 12 will continue downward in its stroke causing the blanking punch 18 to slide axially downward around punch 16, as the pin 70 moves along the slots 72. The increased compression tension from spring 21 will increase the pressure of the pin 70 against the stripper 28. The lancing punch 16 is thus maintained in alignment during the insertion and seating of the paper disc 36 over the flash holes 52 at the bottom of the anvilled battery cup 50.

While the particular embodiments of the invention have been described for purposes of illustration, it will be understood that various changes and modifications can be made therein within the spirit of the invention, and the invention accordingly is not to be taken as limited except by the scope of the appended claims.

I claim:

1. Apparatus for covering flash holes formed in the closed end of a tubular primer battery cup open at the other end comprising:
   (a) tooling means including a biased inner punch positioned and slideable axially within an outer punch;
   (b) carrier means for transporting the primer battery cup to a position below said tooling means so that its open end faces and is aligned with said punches; and
   (c) covering means positioned between said tooling means and said carrier means whereby the downward movement of said tooling means will cause said punches to pierce and slit said covering means and will cause the pierced portion of said covering means to be blanked, inserted and seated into the open end of the battery cup to cover the flash holes at its closed end.

2. The apparatus of claim 1 wherein the inner punch is spring loaded at one end and pointed at the other, said pointed end piercing and slitting said covering means as the tooling means moves downward.

3. The apparatus of claim 2 wherein the pointed end of the inner punch is provided with a plurality of flats spaced circumferentially to slit said covering means in a predictable manner.

4. The apparatus of claim 2 wherein the outer punch is mounted at one end in a die means adapted to move vertically and further comprising a stripping means located between said covering means and said die means, the downward movement of said die means causing the other end of said outer punch to move through an aperture in said stripping means and blank a portion of the covering means.

5. The apparatus of claim 4 wherein the downward movement of said inner punch is stopped by mechanical means prior to seating of said blanked portion at the closed end of the battery cup.

6. The apparatus of claim 5 wherein said mechanical stopping means is the top of an anvil projecting axially from the closed end of the battery cup toward its open end.

7. The apparatus of claim 5 wherein said mechanical stopping means is a pin secured to the pointed end of said inner punch, said pin causing the inner punch to stop when the pin comes into contact with the upper end of said stripping means.

8. The apparatus of claim 5 wherein the stopped inner punch maintains the alignment of the outer punch so that further downward movement of said tooling means will cause the outer punch to insert the blanked portion of the covering medium completely into the battery cup and seat it accurately over the flash holes.

9. A method for covering flash holes formed in the closed end of a tubular primer battery cup open at the other end comprising:
   (a) transporting the battery cup to a tooling station with the open end of said cup facing upward;
   (b) providing a strip of covering medium above said open end;
   (c) piercing said strip so as to cause it to slit predictably;
   (d) blanking a disc-shaped portion of said strip which has been pierced at its center;

(e) inserting said disc-shaped portion into the open end of the battery cup; and (f) seating said disc-shaped portion at the closed end of the battery cup to cover said flash holes.

10. The method of claim 9 wherein the pierced center of the disc-shaped portion of the covering medium passes around an anvil projecting axially from the closed end of the battery cup toward its open end.

11. The method of claim 10 wherein said anvil is cone-like in shape, and the insertion of said disc-shaped portion into the battery will cause the previously formed slits to slit further predictably as the disc-shaped portion passes around the anvil.

12. Tooling apparatus comprising a first punch positioned within and adapted to slide coaxially with respect to a second punch, said first punch being spring-biased at one end and pointed at the other end, said second punch being mounted at one end in die means having a vertical stroke, the pointed end of the first punch projecting from the other end of said second punch, said second punch being adapted to slide downward around the first punch during the downward stroke of said die means whenever the pointed end of said first punch is stopped.

13. The tooling apparatus of claim 12 wherein said pointed end of the first punch is provided with a plurality of flats spaced circumferentially.

14. The tooling apparatus of claim 12 wherein the other end of said second punch has a substantially flat annular surface which is capable of blanking a disc-shaped portion of material after said portion has been pierced at its center by the pointed end of the first punch.

15. The tooling apparatus of claim 14 wherein the blanked disc-shaped portion is inserted into a tubular member by the annular surface of the second punch as the die means completes its downward stroke.

16. The tooling apparatus of claim 15 wherein the pierced center of the disc-shaped portion is adapted to receive a vertical member projecting axially within the tubular member as the disc-shaped portion is inserted into the tubular member.

* * * * *